US010526711B2

(12) United States Patent
Forstpointner et al.

(10) Patent No.: US 10,526,711 B2
(45) Date of Patent: Jan. 7, 2020

(54) PLASTICS MATERIAL SUBSTRATE HAVING A SILICON COATING

(71) Applicant: Wacker Chemie AG, Munich (DE)

(72) Inventors: Gerhard Forstpointner, Kastl (DE); Bernhard Baumann, Emmerting (DE); Michael Fricke, Burghausen (DE)

(73) Assignee: Wacker Chemie AG, Munich (DE)

( * ) Notice: Subject to any disclaimer, the term of this patent is extended or adjusted under 35 U.S.C. 154(b) by 229 days.

(21) Appl. No.: 15/326,522

(22) PCT Filed: Aug. 26, 2015

(86) PCT No.: PCT/EP2015/069494

§ 371 (c)(1),
(2) Date: Jan. 16, 2017

(87) PCT Pub. No.: WO2016/030402

PCT Pub. Date: Mar. 3, 2016

(65) Prior Publication Data

US 2017/0204520 A1 Jul. 20, 2017

(30) Foreign Application Priority Data

Aug. 28, 2014 (DE) ..... 10 2014 217 179

(51) Int. Cl.
*C23C 24/04* (2006.01)

(52) U.S. Cl.
CPC ..... *C23C 24/04* (2013.01)

(58) Field of Classification Search
CPC ..... C23C 24/04
USPC ..... 427/180
See application file for complete search history.

(56) References Cited

U.S. PATENT DOCUMENTS

| | | | | |
|---|---|---|---|---|
| 4,806,317 | A | 2/1989 | Boone et al. | |
| 6,007,869 | A | 12/1999 | Schreieder et al. | |
| 6,375,011 | B1 | 4/2002 | Flottmann et al. | |
| 7,490,785 | B2 | 2/2009 | Weidhaus | |
| 7,549,600 | B2 | 6/2009 | Hesse et al. | |
| 2005/0034430 | A1 | 2/2005 | Holzlwimmer et al. | |
| 2007/0040056 | A1* | 2/2007 | Weidhaus | B02C 19/068 241/39 |
| 2009/0095710 | A1* | 4/2009 | Kim | C01B 33/027 216/37 |
| 2009/0114748 | A1 | 5/2009 | Gruebl et al. | |
| 2009/0155607 | A1 | 6/2009 | Huck et al. | |
| 2012/0156413 | A1 | 6/2012 | Kondou et al. | |
| 2012/0183686 | A1 | 7/2012 | Ohs | |

(Continued)

FOREIGN PATENT DOCUMENTS

| | | | |
|---|---|---|---|
| CN | 101379119 | A | 3/2009 |
| DE | 102006014874 | A1 | 10/2007 |

(Continued)

*Primary Examiner* — Alexander M Weddle
(74) *Attorney, Agent, or Firm* — Brooks Kushman P.C.

(57) ABSTRACT

Plastic material-comprising surfaces of a substrate are coated with elemental silicon by cold gas spraying by injecting a powder containing silicon into a gas and powder with a high velocity onto the substrate surface, such that the silicon forms a firmly adherent coat on the substrate surface comprising the plastics material. Apparatuses having such silicon-coated surfaces are useful in minimizing contamination of polycrystalline silicon production, processing, packaging, and transport.

19 Claims, 1 Drawing Sheet

(56) References Cited

U.S. PATENT DOCUMENTS

| | | | |
|---|---|---|---|
| 2013/0129976 | A1 | 5/2013 | Hertter et al. |
| 2013/0189176 | A1 | 7/2013 | Wochner et al. |
| 2013/0309524 | A1 | 11/2013 | Vietz et al. |
| 2016/0176641 | A1 | 6/2016 | Lazarus et al. |

FOREIGN PATENT DOCUMENTS

| | | | |
|---|---|---|---|
| DE | 102009052983 | A1 | 5/2011 |
| EP | 1334907 | B1 | 8/2003 |
| EP | 1553214 | A2 | 7/2005 |
| EP | 2620411 | A1 | 7/2013 |
| JP | 57067019 | A | 4/1982 |
| JP | 2005305765 | A2 | 11/2005 |
| WO | 14074819 | A1 | 5/2014 |
| WO | 2015014688 | A1 | 2/2015 |

* cited by examiner

PLASTICS MATERIAL SUBSTRATE HAVING A SILICON COATING

CROSS REFERENCE TO RELATED APPLICATIONS

This application is the U.S. National Phase of PCT Appln. No. PCT/EP2015/069494 filed Aug. 26, 2015, which claims priority to German Application No. 10 2014 217 179.2 filed Aug. 28, 2014, the disclosures of which are incorporated in their entirety by reference herein.

BACKGROUND OF THE INVENTION

1. Field of the Invention

The invention relates to silicon-coated plastics material substrates. Silicon-coated plastics material substrates may be used to make low-contamination or contamination-free surfaces of product-contacting component parts of plants or apparatuses for production, further processing, and logistics (packaging/transport) of polycrystalline silicon.

2. Description of the Related Art

Polycrystalline silicon (polysilicon) is, for example, deposited from monosilane or from chlorosilanes such as trichlorosilane onto thin rods by the Siemens process to obtain polycrystalline silicon rods which are subsequently comminuted into polycrystalline silicon chunks (polysilicon chunk). Once comminution into chunks has been carried out, the chunks are typically graded into particular size classes. Once sorted and graded, the chunks are metered out to a particular weight and packed in a plastics material bag. The chunks are optionally subjected to wet-chemical cleaning prior to packing. The chunks typically need to be transported from one plant to another between the individual processing steps, e.g. from the comminution plant to the packing machine. This typically involves intermediately storing the chunks in buffer containers which are typically plastics material boxes.

Polysilicon chunk exhibiting a very low degree of contamination is desired for applications in the semiconductor and solar industries. It is thus necessary for the comminution into chunks, the sorting and grading, the metering-out and the packing to be performed in a very low-contamination fashion.

One process for sorting, grading, metering-out and packing of chunks is disclosed in US 2013309524 A1. The polycrystalline silicon is intially portioned and weighed before packing. The polysilicon chunks are transported via a conveyor channel and separated into coarse and fine chunks using at least one sieve. The chunks are weighed using a metering balance and metered out up to a target weight before subsequently conducted away via a removal channel and transported to a packing unit. The at least one sieve and the metering balance preferably have surfaces, at least in part, of a low-contamination material, for example a hard metal. The sieve and metering balance may have a partial or complete coating. The coating employed is preferably a material selected from the group consisting of titanium nitride, titanium carbide, aluminum titanium nitride and DLC (diamond-like carbon).

EP 1 334 907 B1 discloses an apparatus for cost-effective fully automatic transporting, weighing, portioning, filling and packing of a high-purity polysilicon chunk, comprising a conveyor channel for the polysilicon chunk, a weighing apparatus connected to a hopper, deflection plates made of silicon, a filling apparatus which forms a plastic bag from a high-purity plastic film and comprises a deionizer which prevents electrostatic charging and thus contamination of the plastic film with particles, a welding device for the plastic bag filled with polysilicon chunk, a flow box which is mounted above the conveyor channel, weighing device, filling device and welding device and prevents contamination of the polysilicon chunk by particles, and a conveyor belt having a magneto inductive detector for the welded plastics material bag filled with polysilicon chunk, all component parts coming into contact with the polysilicon chunk being sheathed with silicon or covered with a highly wear-resistant plastic material.

US 20120156413 A1 describes a two-layer construction of plastics material sheets on a metallic base body. The base body is faced with the sheets, the sheets being secured using bolts or the like made of material the same as or similar to the material from which the sheets are made. Transport channels and containers/hoppers coming into contact with polysilicon may be similarly formed.

U.S. Pat. No. 6,375,011 B1 proposed a process for conveying silicon chunk comprising passing the silicon chunks over a vibratory conveyor conveying surface manufactured from highest-purity silicon. However, it has become apparent that loosening and even rupture of the conveying surface silicon facing can occur during operation of such vibratory conveying units. There is thus also a risk of product contamination during conveying.

Granular polycrystalline silicon or "granular polysilicon" for short, is an alternative to polysilicon produced in the Siemens process. While the Siemens process affords the polysilicon as a cylindrical silicon rod that requires time- and cost-intensive comminution and possibly even cleaning prior to further processing thereof, granular polysilicon exhibits the properties of a dry bulk material and may be employed directly as raw material, for example for single-crystal production for the photovoltaic and electronic industries.

Granular polysilicon is produced in a fluidized bed reactor. This is accomplished by fluidizing silicon particles using a gas stream in a fluidized bed and heating the bed up to high temperatures using a heating apparatus. Addition of a silicon-containing reaction gas such as monosilane or a chlorosilane, optionally in a mixture with hydrogen, brings about a pyrolysis reaction at the hot particle surface. This deposits elemental silicon on the silicon particles and the individual silicon particles increase in diameter. Regularly withdrawing particles that have grown in diameter and adding of relatively small silicon particles as seed particles allows the process to be operated in continuous fashion with all the attendant advantages thereof.

U.S. 20120183686 A1 describes metal tubes whose interior surfaces have at least a partial coating of silicon or a material comprising silicon. Particulate silicon is transported through these tubes. The material comprising silicon may be, inter alia, fused silica, silcon carbide or silicon nitride. Such tubes may be used in particular in the production of granular polysilicon, wherein seed particles or granular polysilicon are transported through such a tube.

U.S. Pat. No. 6,007,869 A discloses a process for producing granular silicon. The inside of the reactor tube made of metal, for example of stainless steel, has a facing of high-purity silica and the outside of said tube has a casing of insulation material having a low thermal conductivity, for example silica material.

The production of high-purity granular polycrystalline silicon requires silicon seed particles. Gas jet mills are known for the production of such silicon seed particles, for example from U.S. Pat. No. 7,490,785 B2. In one embodiment the parts of the apparatus coming into contact with the silicon particles consist of an outer metallic shell having an interior wall provided with a coating. Silicon in mono- or polycrystalline form or a plastics material are employed as the coating.

The abovedescribed jet mills are not suitable for producing silicon seed particles having particle sizes greater than 1250 μm. However, recourse may be made to roll crushers to produce silicon seed particles of such a size. JP 57-067019 A discloses the production of silicon seed particles by comminution of polycrystalline silicon in a roll crusher and subsequent fractionation by sieving. The rolls are manufactured from high-purity silicon.

U.S. Pat. No. 7,549,600 B2 discloses a process for producing silicon fines by comminution in a crushing plant and grading of the fines, a portion of the crushed material having an edge length less than or equal to the maximum edge length of the desired silicon fines (fraction 1) being collected in a collection container 1 and the portion of the crushed material having an edge length greater than the edge length of the desired silicon fines (fraction 2) likewise being collected. In one embodiment a portion of the fines having an edge length less than the minimum length of the desired silicon fines is separated out of fraction 1 and collected (fraction 3). The obtained fractions 1 and 3 may be used as seed particles for deposition of polycrystalline silicon in a fluidized bed process. The crushing tools have a surface made of a hard metal (particular preference being given to tungsten carbide in a cobalt matrix) or of silicon.

It is known from the prior art to face plant parts with silicon or plastics material or to manufacture said parts entirely from one of these materials. Hard metals are also used as low-contamination materials of construction when handling silicon. Facings are preferable since a metal base body confers greater stability on the plant part. However, the facings with plastics material or silicon known from the prior art are not always stable. Abrasion and consequent damage to the facings may occur. This can result in the plastics materials of the facing contaminating the polysilicon, particularly with carbon. Damage to the facing furthermore exposes the surface of the generally metallic base body which can result in contamination of the polysilicon with metallic particles. It may be possible to further reduce the surface contamination of polysilicon chunks by wet-chemical cleaning though this entails additional costs and complexity.

SUMMARY OF THE INVENTION

The object to be achieved by the invention arose from the problems described above relative to preventing contamination of polysilicon. This and other objects are achieved by a process for silicon-coating a plastics material-comprising surface of a substrate by cold gas spraying, comprising injecting a powder comprising silicon into a gas and applying said powder with a high velocity to the substrate surface comprising the plastics material, so that the silicon forms a coat firmly adherent on the substrate surface comprising the plastics material. The object is also achieved by an apparatus which at least in part comprises a surface made of a plastics material, wherein the plastics material surface has a firmly adherent silicon coat.

DETAILED DESCRIPTION OF THE PREFERRED EMBODIMENTS

Figure 1:
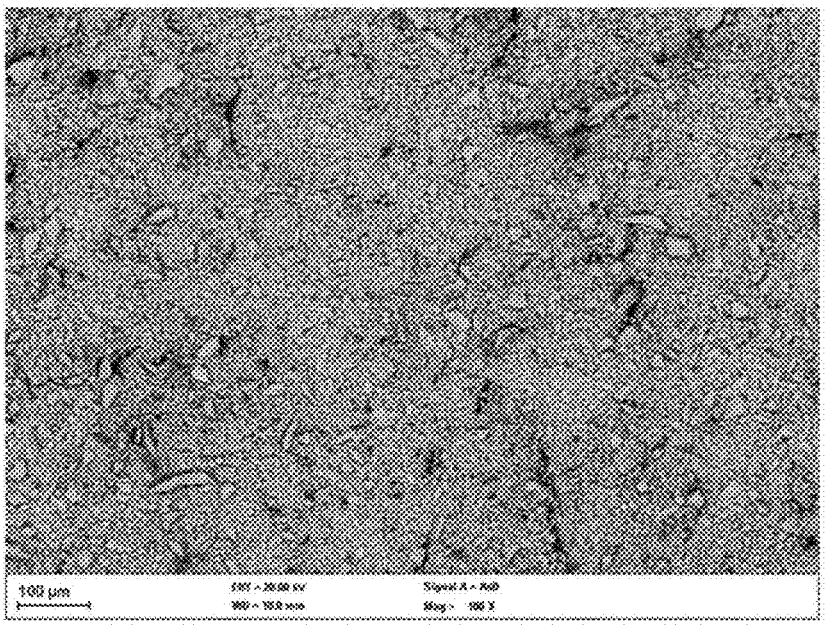
FIG. 1 shows an SEM image of a substrate made of polyamide that has been provided with a silicon coat.
Figure 2:
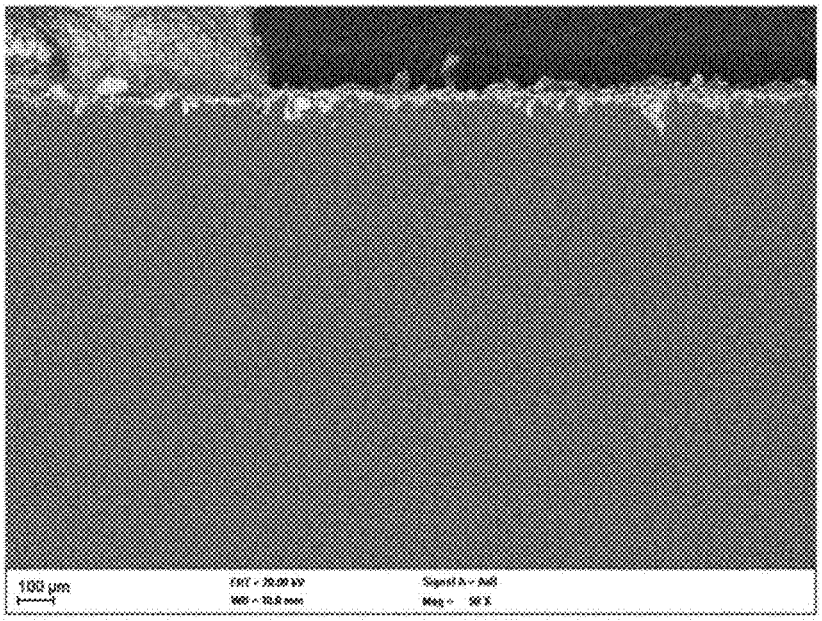
FIG. 2 shows an SEM image of a cross section of the substrate.

Preferred embodiments of the process and of the apparatus are apparent from the description which follows and the dependent claims.

Cold gas spraying (also known as kinetic spraying) comprises applying powder to a support material (substrate) at a very high velocity. The material (powder) to be sprayed is typically introduced to the gas via a powder conveyor, heated up to several hundred degrees and introduced to the spraying system comprising a de Laval nozzle which accelerates the gas comprising the introduced particles to supersonic velocities.

From a process engineering standpoint, cold gas spraying distinguishes itself from thermal spraying by comparatively simple process control since the only process parameters that may be directly contolled are gas pressure and gas temperature.

The gas jet accelerates the injected particles to such a high velocity that, in contrast to other thermal spraying processes, even without preceding incipient or complete melting, the particles form a coat on impacting the substrate that is homogeneously closed and firmly adherent on the substrate surface. The kinetic energy at the time of impact is not sufficient to result in complete melting of the particles.

In the context of the present invention, description of the silicon coat as firmly adherent is to be understood as meaning that low level mechanical action, for example rolling or sliding of silicon material over the coat, results merely in wear due to attrition and not in any particles breaking out of the coat.

The process may be used to silicon-coat a very wide variety of substrates made of thermoplastic, thermosetting and elastomeric plastics materials.

Coating metallic substrates employs gas jet temperatures of up to 950° C. The gas pressure may be up to 50 bar.

Coating plastics material-containing surfaces requires markedly lower gas pressures and gas temperatures. The gas temperature is preferably in the range of from 200° C. to 550° C., it being necessary to take into account that erosion (material removal at the substrate) occurs on any plastics material type above a certain temperature.

The gas velocity is preferably several times the speed of sound a (e.g. 971 m/s for helium or 334 m/s for nitrogen at 0° C.); the gas jet accelerates the particles to velocities of from 500 m/s to 1500 m/s before impact on the substrate surface to be coated.

By contrast to hard, ductile and relatively highly thermally resilient metallic surfaces, plastics material substrates have elastic, plastic to brittle properties and relatively low thermal resilience. To apply a durable silicon coat on a plastics material surface, the parameters of spray distance to the substrate surface, amount of powder introduced, feed rate of the robot and associated optimal particle size are tailored to one another. The quality of the sprayed-on silicon coat is additionally determined by process parameters dependent on the geometry of the body to be coated. For example, for flat substrates the parameters line spacing and line overlap are crucial for a meandering traverse path of the spray jet on the substrate surface. By contrast for rotationally symmetrical bodies the rotation of the substrate body, clamped on a lathe for example, plays an essential role.

The silicon particles ideally possess exactly the amount of kinetic energy required to plastically deform the plastics material. The particle thus penetrates by mechanical deformation into the plastics material surface (just far enough) for said particle to exhibit mechanical adhesion and also to become part of the silicon coating.

Process gases employed in the cold gas spraying are preferably the inert gases nitrogen, helium and mixtures thereof, it being particularly preferable for these gases to be employed in high-purity form. High-purity is to be understood as meaning that impurities are present in amounts of less than 5 ppmv.

The use of high-purity gases avoids incorporation of contaminants, for example metals, dopants or carbon, into the silicon coat by means of the gas.

The de Laval nozzle is preferably made of silicon carbide or of tungsten carbide in a cobalt matrix.

The powder preferably comprises polycrystalline silicon having grain sizes of from 1 to 400 μm, more preferably having grain sizes of from 20 to 80 μm. Grain sizes of from 20 to 80 μm produce a particularly homogeneous coating.

One preferred embodiment employs silicon dust particles formed as a by-product in the milling of granular polycrystalline silicon to afford seed particles. A detailed description of a suitable milling process may be found in U.S. Pat. No. 7,490,785 B2. The air jet mill preferably has a facing of a high-purity material of construction, particular preference being given to silicon. This minimizes contamination both of the seed particles and of the silicon dust generated.

Silicon dust particles from the milling exhibit a low level of contamination with metals that sums to no more than 80 ppbw.

The maximum levels of contamination with metals are preferably:

Fe: max. 10 ppbw;
Cr: max. 5 ppbw;
Ni: max. 5 ppbw;
Cu: max. 5 ppbw;
Zn: max. 12 ppbw;
Na: max. 5 ppbw.

The maximum levels of contamination with boron and phosphorous are preferably 25 ppta and 200 ppta respectively.

The maximum level of carbon contamination of the particles is preferably 10 ppmw.

The process preferably produces a coat thickness of between 1 and 500 μm. A coat thickness of between 5 and 20 μm is particularly preferred since this thickness results in particularly good adhesion and durabilty of the coating.

The plastics material substrate is preferably made of polyethylene, polypropylene, polyamide, polyurethane, polyvinylidene fluoride, polytetrafluoroethylene or ethylene tetrafluoroethylene (ETFE). Said substrate preferably has a thickness of at least 1 mm.

It is apparent that a tight-closed and homogeneous silicon coat having a coat thickness of about 15 to 20 μm has been produced on the polyamide substrate.

The plastics material employed preferably has a hardness of at least 40 Shore D. The use of LDPE (low-density polyethylene) is particularly preferred.

Also particularly preferred is the use of polyurethane having a hardness of 55-95 Shore A. It is possible to produce particularly homogeneous silicon coatings on such a substrate.

Shore hardness is defined in the standards DIN ISO 7619 parts 1 and 2 and DIN 7868-1.

Application of a polycrystalline silicon coating hardens the plastics material substrate. This is associated with reduced wear of the plastics material surfaces.

Silicon coatings also minimize contamination with carbon from the plastics material substrate.

One embodiment provides a metallic base body having a plastics material coat or facing disposed upon it, the plastics material coat or facing having a silicon coating. The surface of the metallic base body may have a plastics material coating or facing on part or all of its surface.

It is preferable when at least the part of the base body that may come into contact with the product to be processed or transported has a plastics material coating or facing and a subsequent silicon coating. The silicon coat serves as the product-contacting coat. The plastics material facing preferably serves as a detection coat for detecting damage to the silicon coating. To this end, the detection coat comprises a substance detectable on the product. Damage to the facing is detectable via contamination of the product with the detectable substance. The product is preferably polycrystalline silicon. Examples of substances readily detectable on polycrystalline silicon include carbon and metals. Consequently, detection coats which are made of plastics material and comprise carbon or metals are particularly preferred.

In one embodiment the seed crystal feeds and product withdrawal sectors in a fluidized bed reactor for producing granular polycrystalline silicon comprise silicon-coated plastics material surfaces. The operating temperature in these regions is typically less than 250° C.

The usage of the silicon-coated plastics material substrates according to the invention is generally restricted to "cold" processes, namely to a temperature range of up to 250° C. However, this applies to virtually all areas of the polysilicon production chain except the actual deposition and the immediately adjacent components subject to greater thermal stress.

It is advantageous that substrates which have complex geometries—and cannot be protected with facings—may also be easily coated. Intercoats, for example adhesion promoters, are not necessary, i.e. the silicon may be directly sprayed onto the plastics material.

The process is moreover highly economic since processing results in barely any silicon losses and only low process temperatures are necessary. The process is altogether more cost-effective and time-efficient than conventional processes for facing plant parts.

Defective coating sections may be repaired relatively easily and cost-effectively. Damaged sections are eliminated by local respraying of silicon onto the sections. By contrast, defective facings require remanufacturing of the facing components from scratch.

Even when the coat comprising silicon is damaged, a high product quality is still assured due to the adjacent plastics material substrate.

Transportation means benefit from reduced weight since facings are not required.

The features cited in connection with the abovedescribed embodiments of the process according to the invention may be applied correspondingly to the apparatus according to the invention. Conversely, the features cited in connection with the abovedescribed embodiments of the apparatus according to the invention can be applied correspondingly to the process according to the invention.

The features cited in connection with the abovedescribed embodiments of the process according to the invention may be implemented either separately or in combination as embodiments of the invention. Said features may further describe advantageous embodiments eligible for protection in their own right.

One embodiment comprises silicon-coating the interior of a non-pressurized single-walled storage and buffer container for granular silicon, where the container is made of plastics material.

A further embodiment comprises providing a pressure-rated storage and process container, comprising a metallic pressure-rated wall and a plastics material inner coating, for example made of fluoroplastics material, with a final surface coating of silicon.

Also comprehended is silicon-coating the interior product-contacting surfaces of transport and storage containers or transport boxes for polysilicon chunk, where the containers or boxes are made of plastics material, for example of polyethylene.

Compared to containers having a facing made of silicon or glass, these containers have a lower weight, a greater useable volume and are also simpler to manufacture.

A further embodiment comprises silicon-coating the interior surfaces of nonmetallic pipes, for example pipes made of polyvinylidene fluoride (PVDF).

A further embodiment comprises providing a pressure-safe metallic pipe, the interior of which is faced with plastics material, preferably with polytetrafluoroethylene (PTFE), with an additional silicon coating on the plastics material.

A further preferred embodiment comprises providing a pressure-safe metallic pipe, the interior of which is coated with plastics material, preferably with ethylene chlorotrifluoroethylene (ECTFE), with an additional silicon coating on the plastics material.

It is likewise possible to provide a silicon coating to plastics material surfaces subject to stress due to sliding but to little abrasive stress due to the product. This reduces wear and thus also reduces product contamination by the plastics material (primarily by carbon).

It is likewise possible to silicon-coat anti-splash facings made of plastics material, for example on filling pipes, suction hoods, and crushing tables.

One embodiment comprises silicon-coating sieve frames and covers of sieving machines for grading granular silicon and chunks, where the frames and covers are made of plastics material. It is preferable to employ sieve screens made of particularly wear-resistant plastics material, namely elastomers having a hardness of more than 65 Shore A, more preferably having a hardness of more than 80 Shore A. Shore hardness is defined in standards DIN 53505 and DIN 7868. One or more sieve screens or the surfaces thereof may be made of such an elastomer.

It is likewise possible to silicon-coat plastics material side-coverings of conveying sectors for silicon chunks, for example in shaker tables. This applies equally for sampling points including plant parts in the vicinity thereof (table, suction hoods) and sampling vessels.

Likewise preferred is the passivation of elastic polyurethane facing materials by coating with silicon. Adhesion of the sprayed-on silicon coat is assured even when the component parts are subjected to severe mechanical deformation (bending, stretching).

The description hereinabove of illustrative embodiments is to be understood as being exemplary. The disclosure made thereby enables a person skilled in the art to understand the present invention and the advantages associated therewith and also encompasses alterations and modifications to the described structures and processes obvious to a person skilled in the art. All such alterations and modifications and also equivalents shall therefore be covered by the scope of protection of the claims.

The invention claimed is:

1. A process for silicon-coating a plastics material-comprising surface of a substrate by cold gas spraying, comprising injecting a powder comprising silicon into a gas and applying said powder with a supersonic velocity to the substrate surface comprising the plastics material, such that the silicon forms a coat adherent on the substrate surface comprising the plastics material.

2. The process of claim 1, comprising injecting the powder into nitrogen or helium or mixtures thereof.

3. The process of claim 1, wherein the powder comprises polycrystalline silicon having grain sizes of from 20 to 80 μm.

4. The process of claim 1, wherein the silicon coat has a coat thickness between 5 and 20 μm.

5. The process of claim 1, wherein the surface comprising the plastics material comprises polyethylene, polypropylene, polyamide, polyurethane, polyvinylidene fluoride, polytetrafluoroethylene or ethylene tetrafluoroethylene.

6. The process of claim 1, wherein the surface comprising the plastics material comprises polyurethane having a hardness of 55-95 Shore A.

7. The process of claim 1, wherein the substrate is a metallic body having a surface, and having a plastics material coating or facing on at least part of the surface.

8. An apparatus which at least in part comprises a surface made of a plastics material, wherein the plastics material surface has an adherent silicon coat prepared by the process of claim 1.

9. The apparatus of claim 8 comprising a base body, a plastics material coating or a plastics material facing on at least a part of a surface of the base body and having a silicon coating on the part of the surface of the base body coated or faced with plastics material.

10. The apparatus of claim 9, wherein the base body of the apparatus is metallic.

11. The apparatus of claim 9, wherein the plastics material coating or the plastics material facing comprises a substance readily detectable on polycrystalline silicon.

12. The apparatus of claim 8, wherein the apparatus is a container made of plastics material and having an adherent silicon coat on its interior surface.

13. The apparatus of claim 8, wherein the apparatus is a pipe made of plastics material having an adherent silicon coat on its interior surface.

14. The apparatus of claim 10, wherein the apparatus is a metallic pipe having a plastics material coating or facing on its interior surface and having an adherent silicon coat on the plastics material-coated or -faced interior surface.

15. The apparatus of claim 14, wherein the apparatus is a seed crystal feed or a product withdrawal sector in a fluidized bed reactor for producing granular polycrystalline silicon.

16. In the production, further processing and logistics (packaging/transport) of polycrystalline silicon, where polycrystalline silicon contacts one or more surfaces, the improvement comprising coating at least one surface with an adherent silicon coat prepared by the process of claim 1.

17. The process of claim 1, wherein the gas is heated to a temperature of from 200° C. to 550° C.

18. The process of claim 1, wherein the velocity and temperature of the gas are such that at a time of impacting of particles with the plastics material there is not complete melting of silicon.

19. The process of claim 1, wherein the powder consists of silicon.

* * * * *